US005395162A

United States Patent [19]

Jay et al.

[11] Patent Number: 5,395,162

[45] Date of Patent: Mar. 7, 1995

[54] SEATING SYSTEM

[75] Inventors: Eric C. Jay, Boulder; John C. Dinsmoor, III, Westminster; Grant C. Denton, Boulder; Richard R. Runkles, Englewood, all of Colo.

[73] Assignee: Jay Medical Ltd., Boulder, Colo.

[21] Appl. No.: 252,982

[22] Filed: Jun. 3, 1994

Related U.S. Application Data

[63] Continuation of Ser. No. 17,880, Feb. 16, 1993, abandoned.

[51] Int. Cl.[6] ..... A47C 7/02

[52] U.S. Cl. ..... 297/452.25; 297/452.41; 5/654; 5/922

[58] Field of Search ..... 297/452.25, 452.24, 297/452.23, 452.26; 5/654, 653

[56] References Cited

U.S. PATENT DOCUMENTS

| | | | |
|---|---|---|---|
| 3,611,455 | 10/1971 | Gottfried | 5/348 |
| 4,588,229 | 5/1986 | Jay | 297/459 |
| 4,643,481 | 2/1987 | Saloff | 297/458 |
| 4,660,238 | 4/1987 | Jay | 5/654 |
| 4,698,864 | 10/1987 | Graebe | 5/441 |
| 4,726,624 | 2/1988 | Jay | 297/425.25 |
| 4,761,843 | 8/1988 | Jay | 5/431 |
| 4,842,330 | 6/1989 | Jay | 297/4 |
| 4,860,397 | 8/1989 | Gusakov | 5/654 |
| 5,018,790 | 5/1991 | Jay | 297/458 |
| 5,189,747 | 3/1993 | Mundy | 5/654 |

FOREIGN PATENT DOCUMENTS 19591 12/1935 United Kingdom .

OTHER PUBLICATIONS

Brochure of Roho, Inc. (c.1991).

*Primary Examiner*—James R. Brittain
*Assistant Examiner*—David E. Allred
*Attorney, Agent, or Firm*—W. Scott Carson

[57] ABSTRACT

A seating system for wheelchairs and other applications. The seating system includes a base member with an upper surface and a fluid pad positioned on the upper surface. The upper surface is preferably contoured and dimensioned to have areas corresponding to the user's ischial tuberosities and coccyx as well as the user's femurs including trochanters. The fluid pad in the preferred embodiment is one piece and has at least three separate and distinct pouches filled with fluid. Each pouch includes seals to contain the fluid in each pouch and to isolate and prevent fluid communication with the fluid in the other two pouches. Each pouch of the pad is then respectively positioned on the upper surface of the base member under the user's ischial tuberosities and coccyx. In this manner, each of the user's ischial tuberosities and coccyx is thereby supported on its own separate and distinct fluid pouch.

41 Claims, 8 Drawing Sheets

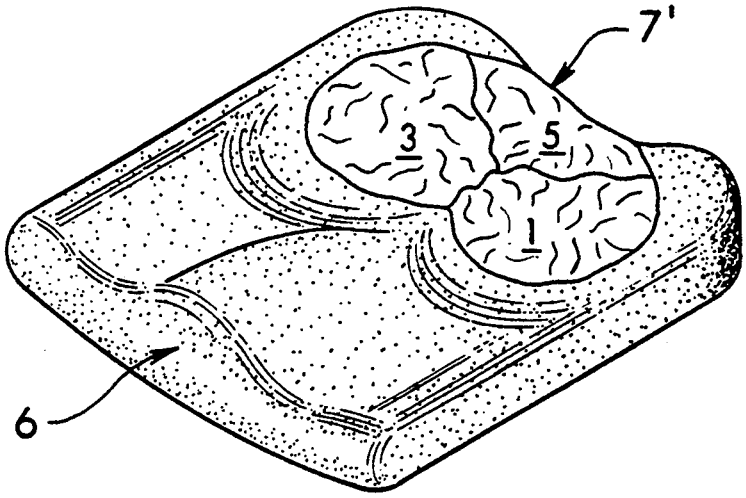
Fig. 9
Fig. 10
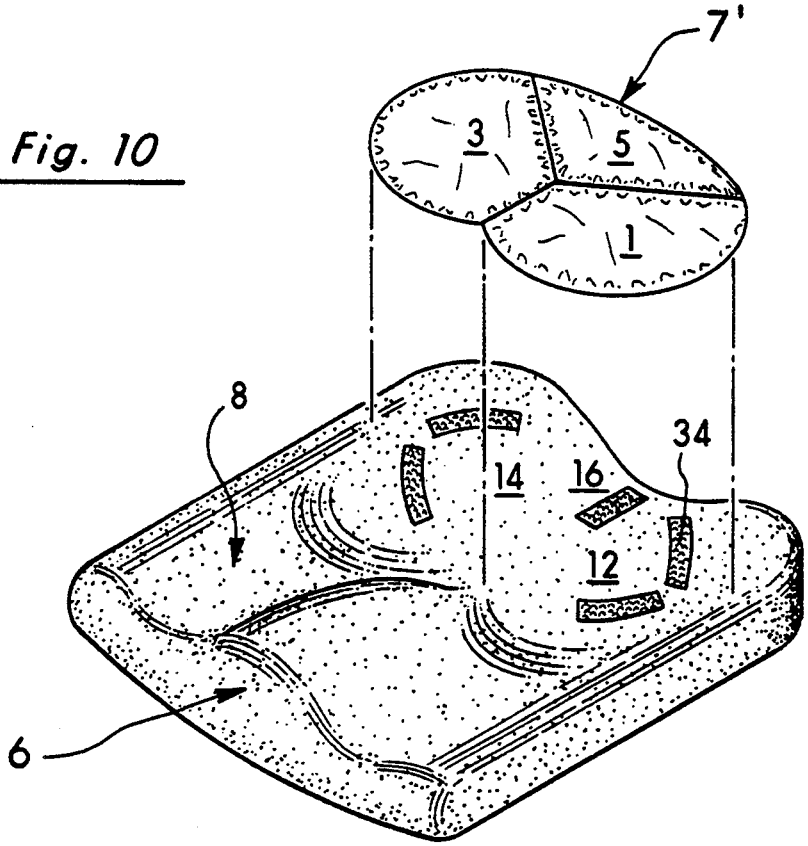

SEATING SYSTEM

This is a continuation of application Ser. No. 17,880, filed Feb. 16, 1993, now abandoned.

BACKGROUND OF THE INVENTION

1. Field Of The Invention

This invention relates to the field of seating systems and more particularly to the field of seating systems for wheelchairs and other applications including where it is desirable to distribute the supporting pressure substantially uniformly throughout the entire engagement area between the user's body and the underlying support structure of the seating system.

2. Discussion Of The Background

It is known and well documented that persons confined to wheelchairs for extended periods of time are subject to and at risk of developing decubitus ulcers or pressure sores. These pressure sores normally occur in the tissue surrounding or adjacent to the bony prominences of the skeletal structure and are due to the pressure applied to them by the weight of the seated person. That is, the tissue between the seated person's bones and the seating surface is normally squeezed under the user's weight. As a result, the normal flow of blood through the capillary vessels to the squeezed tissue areas can become occluded or blocked. Continued pressure and the resulting lack of blood flow to the tissue will cause necrosis (dead tissue) to form and in the most severe cases may cause an open wound from the epidermis (skin) all the way down through the fatty and muscular tissue to an exposed bone. Unattended, the decubitus ulcers (pressure sores, wounds) may become infected and eventually may even become fatal to the seated person. The most common areas of pressure sore development are the ischial tuberosities and the coccyx (tailbone).

There have been numerous prior art approaches developed to specifically deal with the associated problems of confined wheelchairs users. A cushion by Roho, Incorporated which consists of an array of upstanding inflatable bulbs has been partially successful in minimizing the effects of pressure on the seated wheelchair user. The Roho cushion basically attempts to equalize the interface pressure across the entire surface of the user in contact with the supporting cushion. The cushion is inflated just to the point where the user is suspended off the bottom of the structure so that the user will not bottom out. The desired result is that the peak pressures which normally occur at the supported skeletal structure are reduced to an average pressure defined by the supported weight of the user divided by the net surface area in contact with the cushion.

While this type of invention may appear theoretically optimal to alleviating the effects of interface pressure on the seated user, the Roho cushion, as originally designed, does not address the need for proper posture and positioning. These are equally critical to the continued health of the wheelchair bound user as is the avoidance of pressure sores. The design of the Roho cushion inherently introduces an amount of undesirable instability. This instability is caused by the communication of air throughout the entire array of inflated bulbs. Thus, the Roho cushion responds to asymmetrical loading or dynamic loads due to mobility requirements of the user in an equal and opposite direction as would be expected. This type of response will aggravate existing asymmetrical postures and in some cases create undesirable seated postures. Prolonged abnormal posture will eventually cause permanent, fixed deformities in the spine.

The original cushion by Jay Medical, Ltd. (U.S. Pat. No. 4,588,229) was developed to address both the problems of pressure and positioning. The original Jay cushion consists of a relatively rigid tray in which a seating well is formed in the rearward portion of the cushion to accept a flexible, sealed bladder or pad containing a viscous fluid. The fluid bladder or pad has a seal along the longitudinal centerline of the cushion which creates two equal side segments to the pad. There are additional seals within the perimeters of these two segments to limit the maximum overall thickness that the pad may achieve in these local areas when the fluid contents are pressurized by the user's seated weight. The resulting assembly is a seating system that not only reduces the interface pressures at the sensitive bony prominences but also provides a stable support surface from which proper postural position can be achieved. This is true regardless of any existing postural asymmetries or dynamic loading caused by mobilization of the wheelchair.

The seam along the longitudinal centerline of the Jay pad specifically prevents an asymmetrical condition from getting worse (i.e., prevents a user's existing pelvic obliquity from bottoming out on the relatively rigid tray). The viscous fluid generates the required amount of pressure equalization under and around the primary bony prominences at risk while seated in the wheelchair. At the same time, it dampens the dynamic response due to mobility of the user. The theoretical deficiency with the Jay design is that because of the longitudinal segmentation of the pad into distinct sides, it may be possible to generate higher interface pressures on one ischial tuberosity than on the other. This is true because the fluid is not able to communicate from one side to the other and thus cannot average the pressures across the entire surface as does the prior art Roho cushion. The design of the original Jay cushion does have the ability to bias or create higher than average pressures at anatomical regions known to be able to sustain increased pressure at reduced risk of tissue breakdown. In this regard, the elevated front portion of the Jay cushion serves such a purpose. That is, the user's thighs (or femurs) in the Jay cushion are supported by a lesser amount of fluid than are the user's buttocks where support is primarily the viscous fluid bladder or pad and a lesser amount of rigid tray material. The end result is that a greater than normal proportion of the user's weight is bearing on the thighs. This reduces the remaining weight portions which must be supported by the user's buttocks which contain the high risk breakdown tissue areas (ischial tuberosities and coccyx).

Later embodiments of the basic Roho cushion design addressed the aforementioned problem by segmenting the array of inflatable bulbs in a manner that allowed the user to over inflate the thigh areas and under inflate the sensitive areas under the buttocks (see U.S. Pat. No. 4,698,864).

A problem was identified with the Jay cushion when used in certain circumstances. If the seated user did not maintain a correct seated posture due to fatigue, poor back position, neurological impairments (e.g., the user slouches in the seat) or the user was placed in a semi-reclined position, the bulk of the fluid in the rear of the cushion would migrate forwardly or rearwardly into any unrestrained areas of the fluid pad. The net effect was that the user's coccyx or tailbone would fail to be supported by any fluid and would come to bear on the underlying relatively rigid tray. This was an undesirable condition for these type of wheelchair users. A design modification was implemented to reduce the risk of bottoming out the cushion when subjected to the circumstances defined above. A second seal was made laterally across the rear half of the fluid pad. This lateral seal essentially trapped a predefined amount of fluid in the rear area of the pad thus preventing the average user from bottoming out his coccyx when reclined or when slouched in the wheelchair. The additional segmenting did, however, further limit the communication of fluid around the buttocks area. Interface pressure measurements compared between the original Jay cushion and the cushion with the lateral seam revealed increased average pressure on the ischial tuberosities due to the added seam. Thus, the overall pressure reducing capabilities of the cushion were sacrificed to prevent bottoming out onto the rigid tray.

Further use and examination of the two Jay cushion configurations identified an additional performance deficiency. On certain users who were particularly bony due to, for example, muscle atrophy or weight loss, the users would continue to bottom out their coccyx on the rigid portion of the cushion. It was determined that the longitudinal seam down the centerline of the Jay pad was contributing to the user's ability to work their coccyx down between the fluid segments on either side of centerline. It was discovered that these problems could be resolved either by overfilling the rear quadrants of the lateral seam pad to prevent bottoming out or by incorporating a dedicated segment or fluid pouch for the coccyx into the pad design. The latter was chosen for the present invention in lieu of overfilling the rear quadrants of the lateral seam pad which could result in higher average cushion interface pressures due to lack of immersion of the user.

SUMMARY OF THE INVENTION

This invention involves a seating system for wheelchairs and other applications. The seating system includes a base member with an upper surface and a fluid pad positioned on the upper surface. The upper surface is preferably contoured and dimensioned to have areas corresponding to the user's ischial tuberosities and coccyx as well as the user's femurs including trochanters. The pad in the preferred embodiment is one piece and has at least three separate and distinct pouches filled with fluid. The fluid preferably has a viscosity of at least one and each pouch includes sealing means to contain the fluid in each pouch and to isolate and prevent fluid communication with the fluid in the other two pouches. Each pouch of the pad is then respectively positioned on the upper surface of the base member under the user's ischial tuberosities and coccyx. In this manner, each of the user's ischial tuberosities and coccyx is thereby supported on its own separate and distinct fluid pouch. By properly adjusting the fluid volume in each pouch, the support pressure on the user's ischial tuberosities and coccyx can be made to be substantially equal or varied as desired.

Several embodiments of the invention are disclosed but in each one, there is a separate and distinct fluid pouch under each of the user's ischial tuberosities and coccyx. In one embodiment, at least one of the fluid pouches is separable from the other pouches of the pad. In another embodiment, additional outer pouches are included in the pad and respectively positioned outwardly of the ischial pouches to support the user's left and right femurs including the trochanters.

BRIEF DESCRIPTION OF THE DRAWINGS

FIG. 9 illustrates a second embodiment of the present invention in which the fluid pad is a simple three pouch pad.

FIG. 10 is an exploded view of the base member and fluid pad of FIG. 9.

DETAILED DESCRIPTION OF THE PREFERRED EMBODIMENTS

Figure 1:
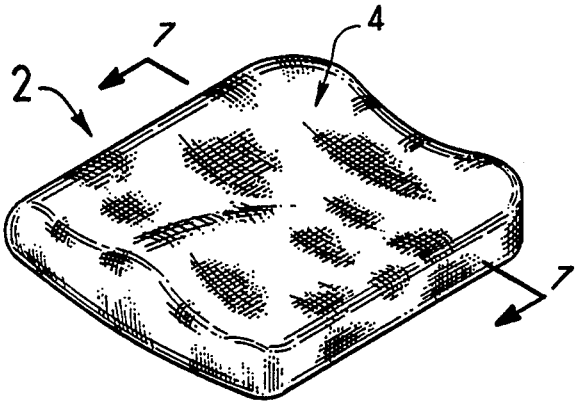
FIG. 1 is a view of the covered seating system of the present invention.
Figure 2:
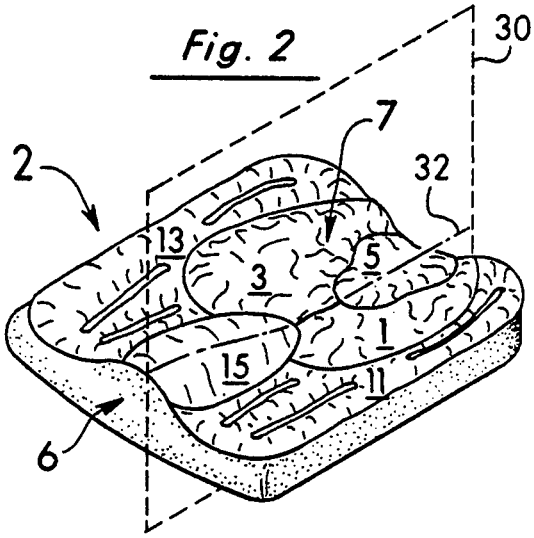
FIG. 2 is a view of the seating system of FIG. 1 with the cover removed to show the underlying base member and the fluid pad which is positioned on it.
Figure 3:
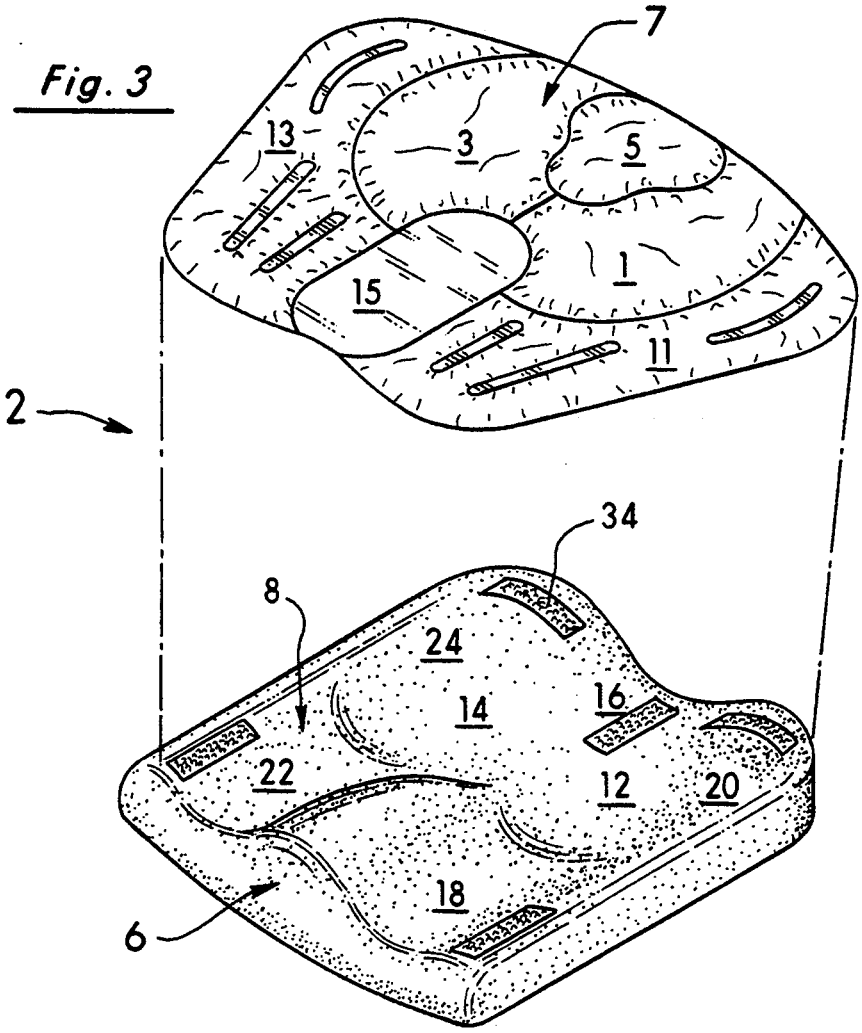
FIG. 3 is an exploded view of the base member and fluid pad.

The seating system 2 of the present invention as best seen in FIGS. 1–3 includes an outer cover 4 (see FIG. 1) positioned over a base member 6 (see FIG. 2) and fluid pad or bladder 7.

The base member 6 can be either a foam cushion or relatively rigid tray and as shown in FIG. 3 has an upper surface 8. This upper surface 8 is contoured and dimensioned to have areas substantially corresponding to the user's buttocks and thighs. More specifically, rear areas 12, 14, and 16 of the upper surface 8 (see FIG. 3) correspond to the areas of the user's buttocks including the user's ischial tuberosities 12' and 14' and coccyx 16' (see also FIG. 4). Additionally, outer areas 18 and 20 on the left side of the upper surface 8 in FIG. 4 correspond to the user's left femur 18' including trochanter 20'. Outer areas 22 and 24 on the right side of the upper surface 8 in turn correspond to the user's right femur 22' including trochanter 24'. Although this base member 6 can be used alone, it preferably is used with the fluid pad 7 of FIG. 5 on it.

Figure 5:
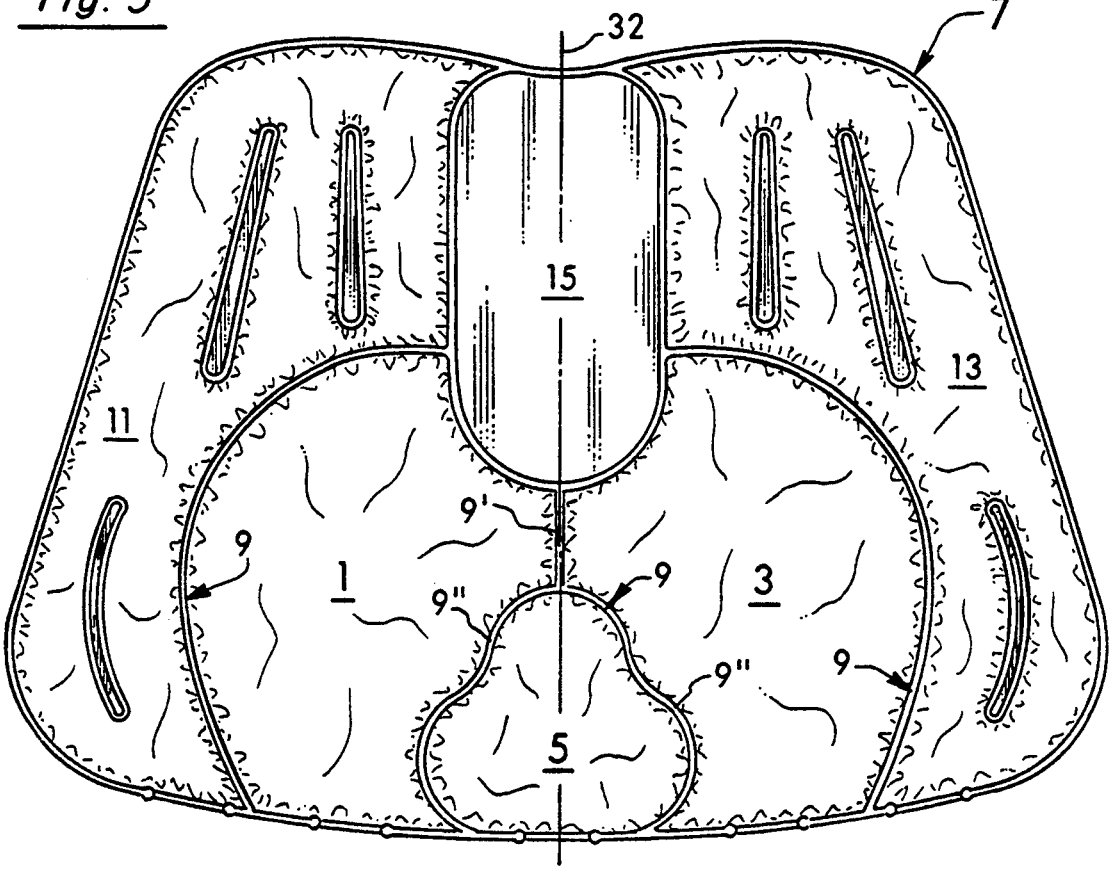
FIG. 5 is a top plan view of the fluid pad of FIG. 3.

The fluid pad 7 of the preferred embodiment as illustrated in FIGS. 3 and 5 includes at least three pouches 1, 3, and 5. Each pouch 1, 3, and 5 contains a fluid and is respectively placed on the upper surface 8 of the base member 6 over the rear areas 12, 14, and 16. The pouches 1, 3, and 5 are thus respectively positioned under the user's ischial tuberosities 12' and 14' and coccyx 16'. Each pouch 1, 3, and 5 further includes sealing means 9 (e.g., heat sealed seam or seams) for containing the fluid within each pouch 1, 3, and 5. The fluid in each pouch 1, 3, and 5 is thereby isolated and prevented from fluid communication with the fluid in the other two pouches. In this manner and in use, each of the user's ischial tuberosities 12' and 14' and coccyx 16' is thus supported on its own separate and distinct fluid pouch 1, 3, and 5.

Figure 4:
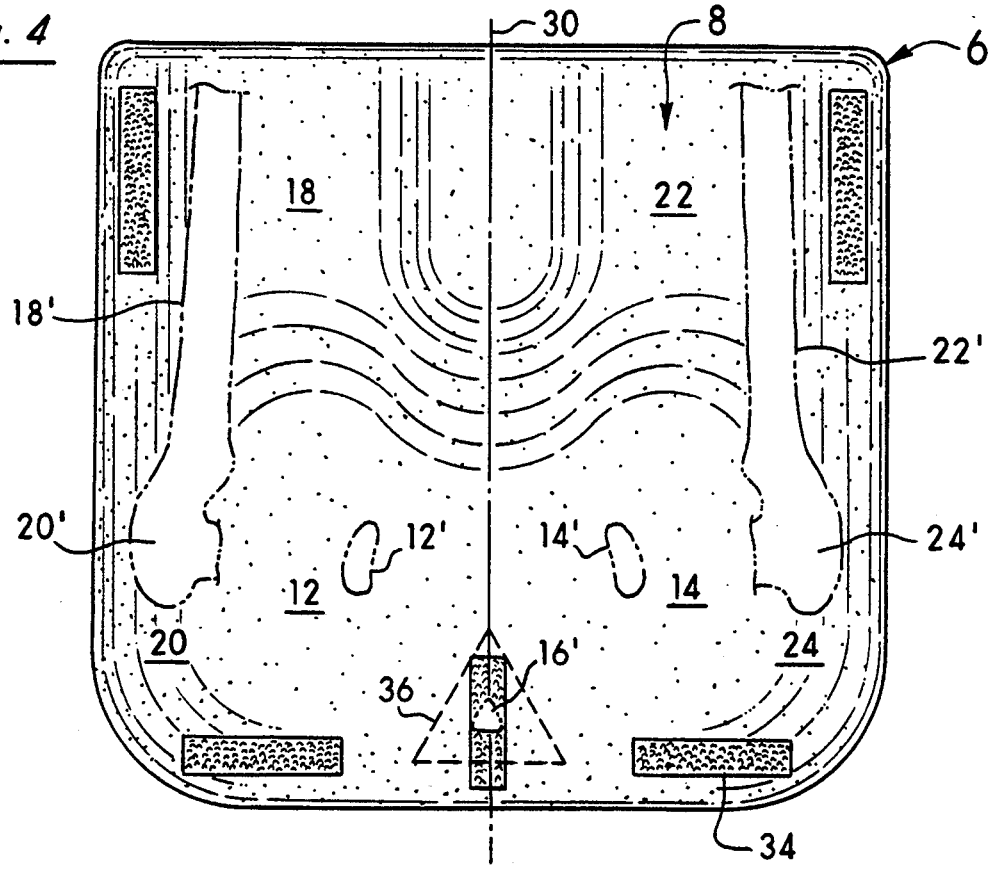
FIG. 4 is a top plan view of the base member of FIG. 3 showing its contoured upper surface and the respective areas of the base member intended to support the areas (shown in dotted lines) of the user's ischial tuberosities, coccyx, and femurs including the trochanters.

As shown in the top plan view of FIG. 4, the upper surface 8 of the base member 6 is substantially symmetrical and extends outwardly on each side of a central plane 30 passing through the upper surface 8. Similarly, the fluid pad 7 (see FIG. 5) preferably has a corresponding symmetry about the central axis 32. In use, the fluid pad 7 is positioned on the upper surface 8 of the base member 6 with the central axis 32 of the pad 7 contained in the central plane 30 of the base member 6. This is also illustrated in FIG. 2. In this manner, the fluid pad 7 has the ischial pouches 1 and 3 positioned on the upper surface 8 of the base member 6 to extend outwardly of the central plane 30 on opposite sides thereof. The coccyx pouch 5, in turn, is positioned on the upper surface 8 to essentially straddle the central plane 30 with portions thereof extending outwardly on each side of the plane 30. Additionally, the common sealing seam 9' (see FIG. 5) between the adjacent portions of the first and second ischial pouches 1 and 3 is substantially aligned with the axis 32. It is also aligned in use to lie in the central plane 30 of the base member 6.

Figure 6:
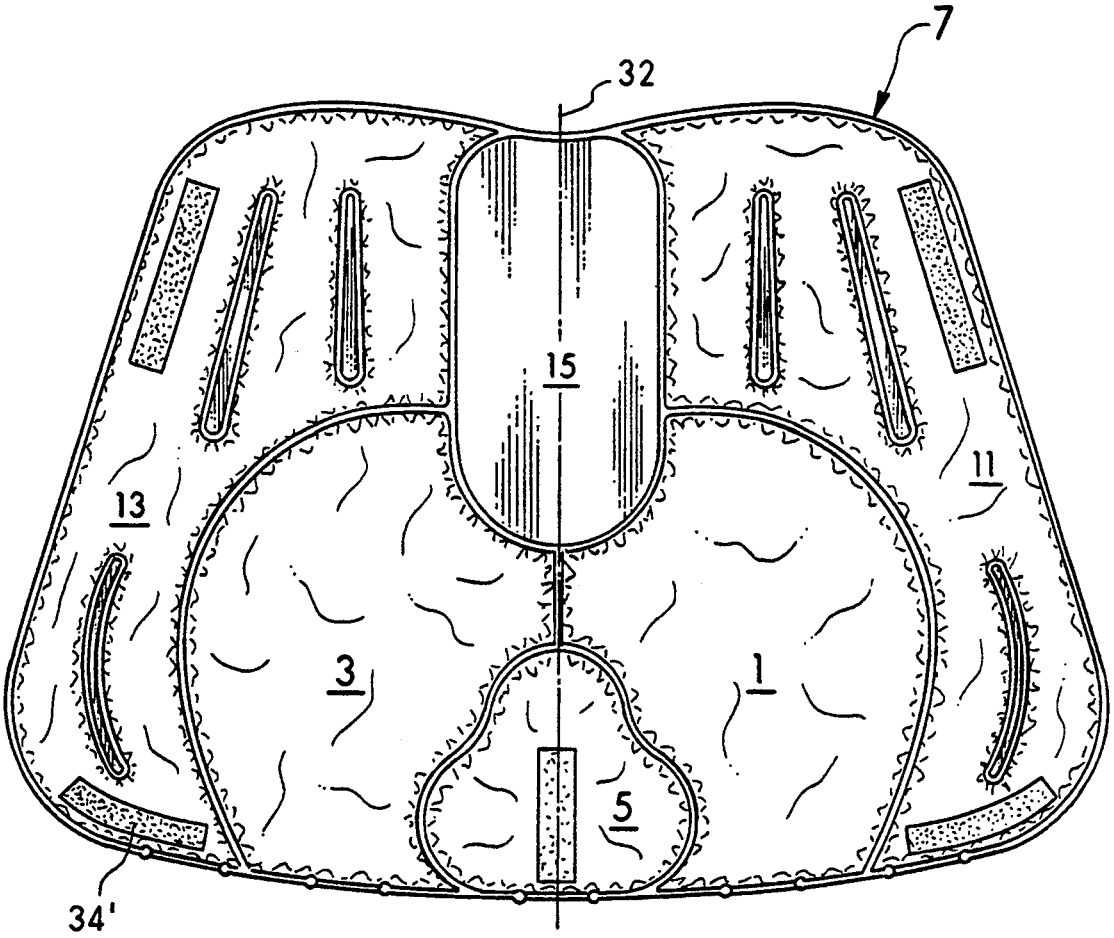
FIG. 6 is a bottom plan view of the fluid pad of FIG. 3.

The fluid pad 7 as shown in FIGS. 4 and 5 is slightly oversized relative to the base member 6, particularly in the rear or seat area. For example, the dimensions of the upper surface 8 of the base member 6 for an adult user may be fourteen to twenty-four inches across and sixteen to twenty inches deep. The fluid pad 7, in turn, may be fourteen to twenty-four inches across in the front, eighteen to twenty-two inches deep, and fourteen to thirty-six inches across at the rear. In use, the fluid pad 7 is essentially bunched together (particularly in the rear) into substantially an overall rectangular shape corresponding to the shape of the upper surface 8 of the base member 6. Thereafter, it is positioned on the upper surface 8 of the base member 6. The fluid pad 7 is then held in place by its own weight or preferably by, for example, hook and loop fasteners 34 and 34' on the upper surface 8 of the base member 6 (see FIG. 3 and 4) and the bottom of the fluid pad 7 (see FIG. 6).

Figure 7:
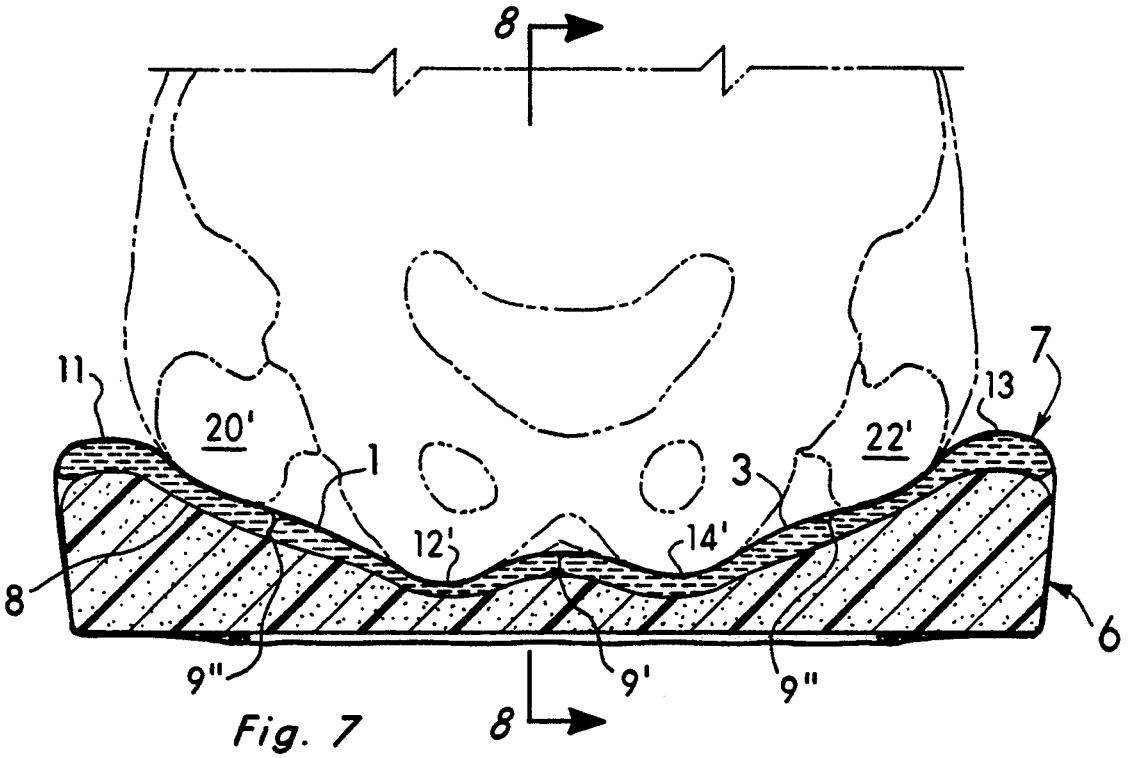
FIG. 7 is a view taken along line 7—7 of FIG. 1 with the user's buttocks including ischial tuberosities shown in dotted lines.
Figure 8:
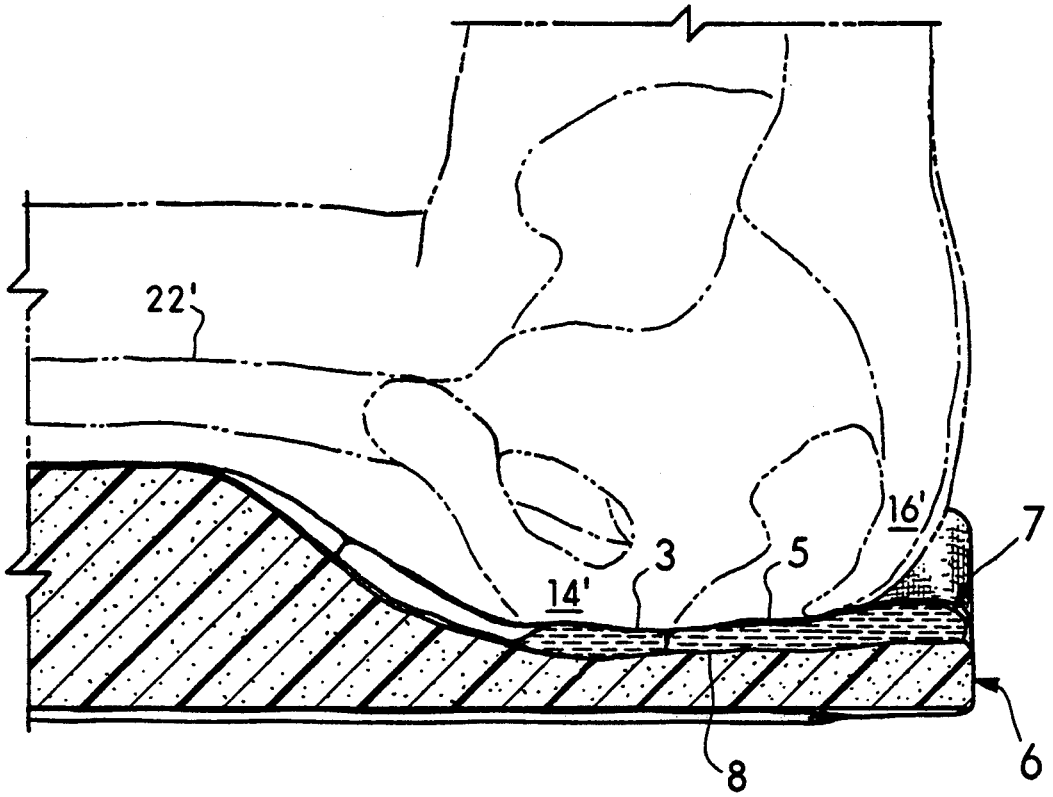
FIG. 8 is a view taken along line 8—8 of FIG. 7 with the user's buttocks including coccyx shown in dotted lines.
Figure 11:
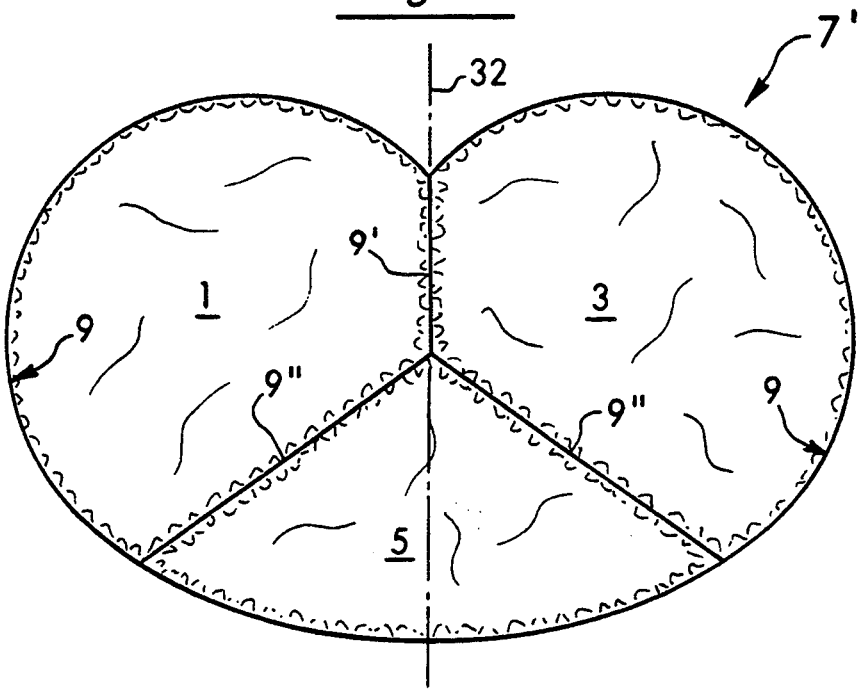
FIG. 11 is a top plan view of the three pouch pad of FIG. 9.
Figure 12:
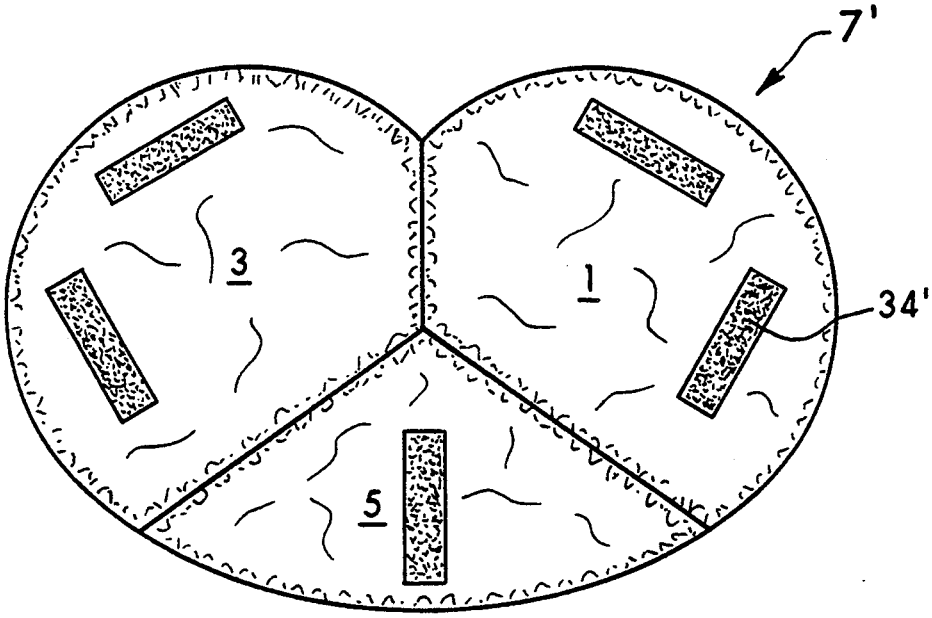
FIG. 12 is a bottom plan view of the three pouch pad of FIG. 9.

The fluid pad 7 is preferably one piece with respective portions of the fluid pouches 1, 3, and 5 (see FIG. 5) immediately adjacent one another and sharing a common sealing seam. For example, the adjacent portions of pouches 1 and 3 share the common sealing seam 9' and pouch 5 has adjacent portions and shared seams 9'' with both pouches 1 and 3. Additionally, the sealing seam for each pouch 1, 3, and 5 has at least a common portion with the sealing seam of each of the other two pouches. For example, pouch 1 has a shared seam portion 9' with pouch 3 and a shared seam portion 9'' with pouch 5. This makes for a very compact pad 7 and also enables the adjacent portions of the pouches 1, 3, and 5 to abut one another when the pad 7 is bunched together and positioned on the upper surface 8 of the base member 6 (see FIGS. 7 and 8). The first and second ischial pouches 1 and 3 as illustrated are substantially mirror images of each other. Additionally, the ischial pouches 1 and 3 are dimensioned so that in use, they substantially correspond to the size of each respective cheek or half side of the user's buttocks. In this regard, each ischial pouch 1 and 3 in use extends outwardly of the axis 32 and central plane 30 anywhere from about three to eight inches and along the axis 32 anywhere from about six to twelve inches. The coccyx pouch 5 is smaller than the ischial pouches 1 and 3 and in use straddles and extends outwardly of the axis 32 anywhere from about two to four inches on each side of the central plane 30 and along the axis 32 and central plane 30 anywhere from about two to six inches. Also as shown, the ischial pouches 1 and 3 have rear portions that straddle the coccyx pouch 5 on each side thereof.

In dimensioning the pouches 1, 3, and 5, the goal is to have each of the pouches dedicated to the approximate seating area of the user's ischial tuberosities 12' and 14' and coccyx 16'. Procedurally, with the pad 7 of the present invention, the most important concern is that the pouch 5 for the user's coccyx 16' be sufficiently sized to accept the anticipated range of motion of the coccyx 16' during normal use of the seating system 2. As a practical matter, this is usually within the triangular area 36 shown on the upper surface 8 of the base member 6 in FIG. 4. This triangular area (e.g. four to seven inches on a side) is then to a large extent used to dictate the size of the coccyx pouch 5 and the overall preferred shape of the coccyx pouch 5 (i.e., triangular with about five to eight inches on a side). Once the coccyx pouch 5 is dimensioned, the ischial pouches 1 and 3 are dimensioned to at least the approximate remaining seating surface occupied by each ischial tuberosity 12' and 14' and adjacent buttocks support area not used by the coccyx pouch 5. In this regard, the ischial tuberosities 12' and 14' themselves are normally about four to eight inches apart and three to six inches from the coccyx 16'. The overall size of each ischial pouches 1 and 3 is also determined by considering the shape of the buttocks and the anticipated motion range of the ischial tuberosities 12' and 14'. This motion is roughly within respective triangular areas corresponding to the triangular motion area 36 of the coccyx 16'.

In the preferred embodiment of fluid pad 7, the remaining areas of the upper surface 8 of the base member 6 on either side of the ischial pouches 1 and 3 are covered by additional, outer pouches 11 and 13. Each of these additional pouches 11 and 13 preferably shares a common sealing seam 9 with the respective ischial pouches 1 and 3. Each additional pouch 11 and 13 also extends along the central plane 30 for a distance substantially greater than the adjacent ischial pouches 1 and 3 extend along the axis 32. Preferably, each additional pouch 11 and 13 extends from the back to the front of the base member 6 and is respectively positioned on the upper surface 8 of the base member 6 over the respective area 18 and 20 and area 22 and 24 (see FIGS. 3 and 4). These areas correspond to the user's left and right femurs 18' and 22' including trochanter 20' and 24' (see also FIGS. 4 and 5). The remaining central pouch 15 is preferably just an unfilled pouch positioned over the abductor area of the upper surface 8 of the base member 6.

One advantage to having each of the pouches 1, 3, 5, 11, and 13 separately sealed is that they can be individually filled as desired. In this regard, the ischial pouches 1 and 3 would normally be filled with equal volumes of fluid with the smaller coccyx pouch 5 filled with a smaller volume of fluid. However, the pouches 1, 3, 5, 11, and 13 could be filled with varying amounts of fluid to achieve any desired distribution of pressures (e.g., equal, unequal, or variable) over the seating system 2. The fluid in the pouches 1, 3, 5, 11, and 13 is preferably incompressible with a viscosity of at least one and more preferably is a highly viscous liquid such as disclosed in U.S. Pat. No. 4,588,229. Such preferred liquids exhibit non-resilient, non-restoring properties typical of plastic or viscous thixotropic materials which flow gradually when pressure is applied to them but which maintain their shape and position in the absence of pressure. However, other highly viscous fluid such as gels, oil, or grease can also be used. Additionally, each pouch 1, 3, 5, 11, and 13 (which may be made of layers of thermoplastic film material such as polyurethane) is preferably only partially filled (e.g., 40% to 70%) with fluid so that there is no distending or tensioning of the pouches in use.

FIGS. 9–12 illustrate a second embodiment of the invention in which the fluid pad 7' consists just of three pouches 1, 3, and 5. As in the preferred embodiment of FIGS. 1–8, the pouches 1, 3, and 5 are dimensioned to be positioned respectively under the user's ischial tuberosities and coccyx. The pouches 1, 3, and 5 as shown in FIGS. 9 and 10 are respectively placed or positioned over the corresponding areas 12, 14, and 16 of the upper surface 8 of the base member 6. The fluid pad 7' like pad 7 is also preferably held in place by hook and loop fasteners 34 and 34' (see FIGS. 10 and 12). Additionally, as illustrated in the top plan view of FIG. 11, the coccyx pad 5 of the fluid pad 7' like that of pad 7 has a substantially triangular shape with the sealing seams 9'' extending outwardly of the central axis 32 and central plane 30 at about 60 degrees. Similarly, the sealing seam 9' between pouches 1 and 3 is aligned with axis 32 and lies in the central plane 30 in use. With fluid pad 7' like pad 7, each of the user's ischial tuberosities and coccyx is supported on its own separate and distinct pouch.

Figure 13:
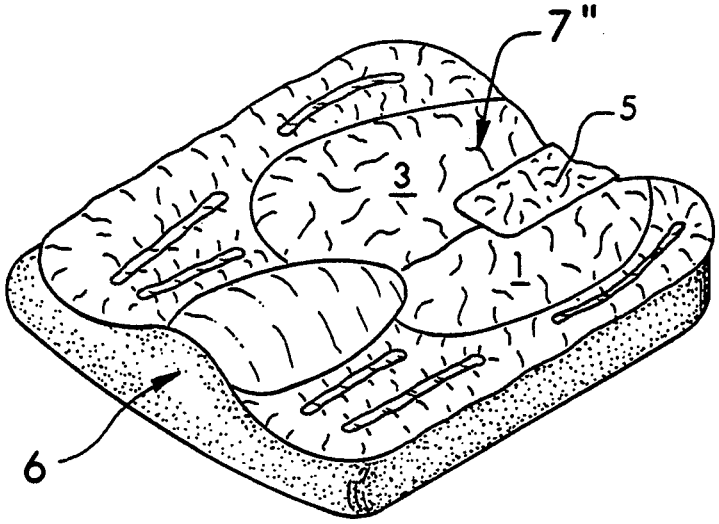
FIG. 13 illustrates a third embodiment of the present invention in which the fluid pad includes at least one separable pouch.
Figure 14:
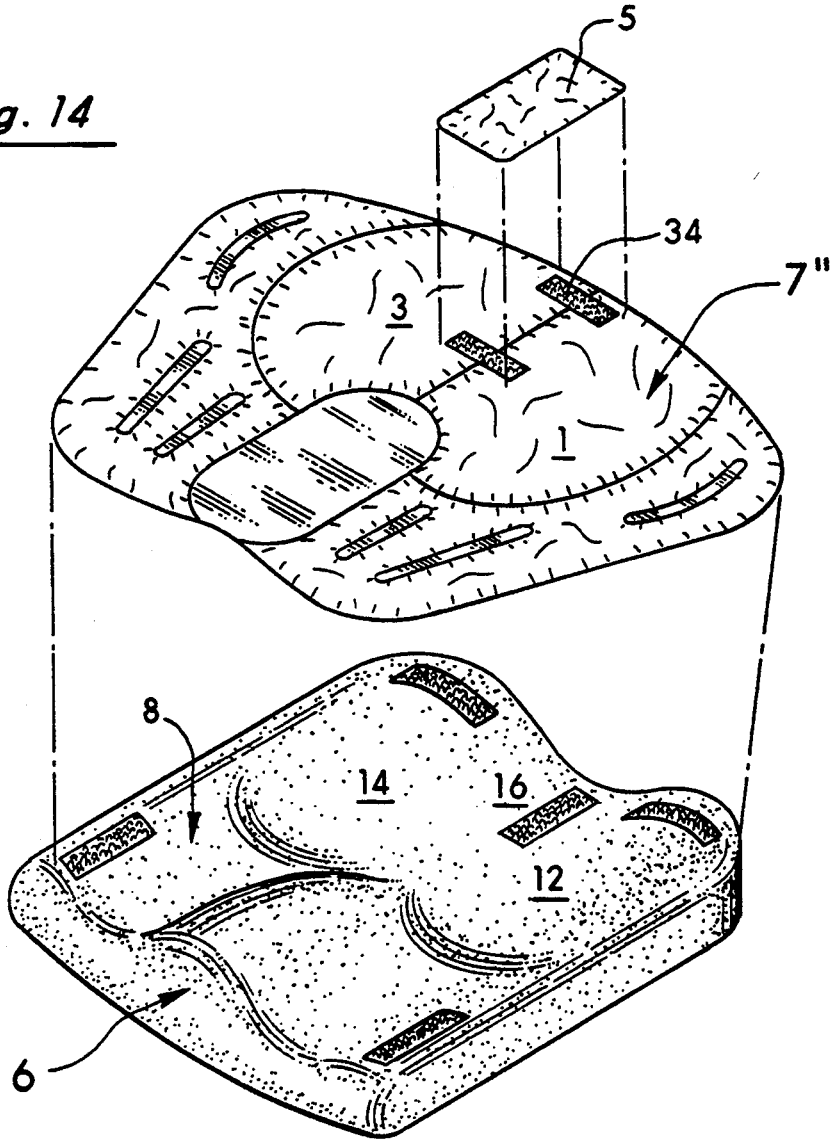
FIG. 14 is an exploded view of the base member and fluid pad of FIG. 13.
Figure 15:
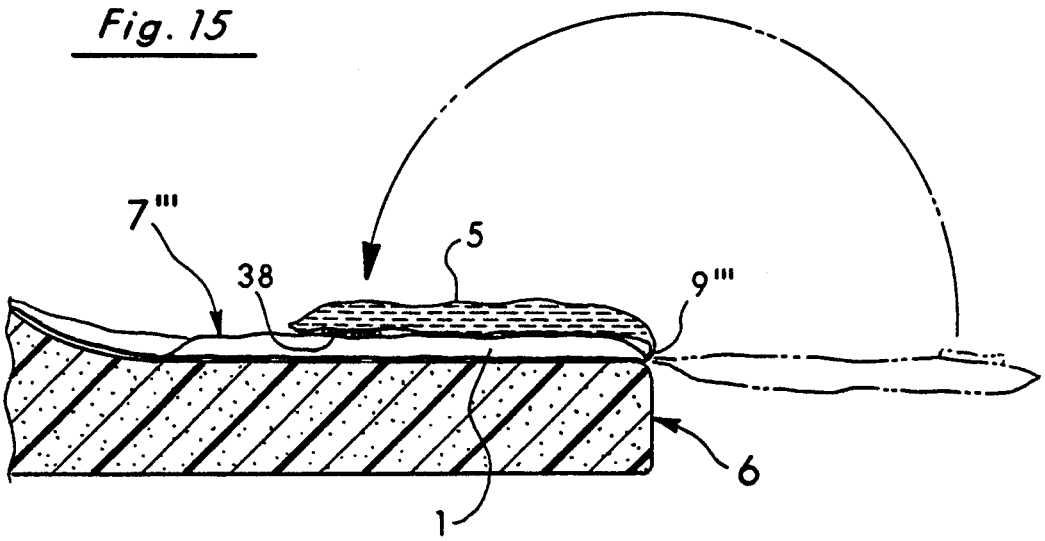
FIG. 15 illustrates a fourth embodiment of the present invention in which the coccyx pouch is secured to the main body of the fluid pad in the fashion of a beaver tail.
Figure 16:
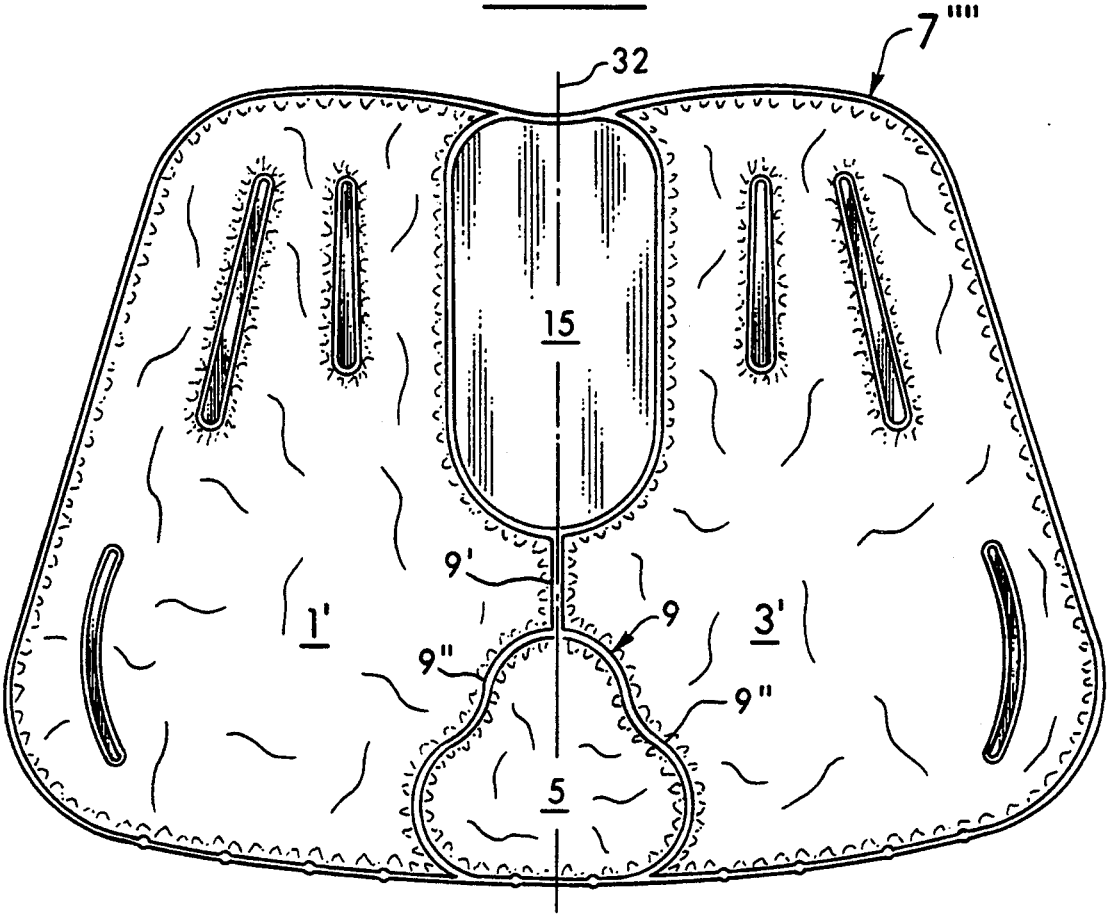
FIG. 16 illustrates a fifth embodiment of the present invention in which each ischial pouch and its adjacent, outer side pouch of FIG. 5 are combined into a single pouch.

Other embodiments of the invention are illustrated in FIGS. 13–14, 15, and 16. In FIGS. 13 and 14, the coccyx pouch 5 is shown as a separate and detachable pouch (e.g., by hook and loop fasteners 34—see FIG. 14). That is, the fluid pad of the present invention is preferably one piece but could have one or more separable pouches 1, 3, and 5. Nevertheless, in use, the fluid pad 7'' of FIGS. 13 and 14 like pad 7 of FIGS. 1–8 respectively positions the pouches 1, 3, and 5 under each of the user's ischial tuberosities and coccyx. In the embodiment of FIG. 15, the coccyx pouch 5 is attached to the main body of the fluid pad 7''' in the fashion of a beaver tail with a sealing seam at 9''' and hook and loop attachments at 38. The embodiment of FIGS. 13–14 and 15 are particularly adaptable as retrofits to existing pads which do not have a separate and distinct coccyx pouch 5. In this manner, each of the user's ischial tuberosities and coccyx is thereby supported on a separate and distinct pouch. In this regard, each such separate pouch need not necessarily be limited or sized just to support an ischial tuberosity or coccyx. For example, the ischial pouch 1 may also support the user's left femur including trochanter. This would simply involve removing, for example, the seams 9 in FIG. 5 between the pouches 1 and 11 and between the pouches 3 and 13 and forming the fluid pad 7'''' of FIG. 16 with its enlarged pouches 1' and 3'. Nevertheless, even with fluid pad 7'''' each ischial tuberosity is respectively supported, in whole or in part, on a separate and distinct pouch from the other ischial tuberosity and coccyx. Similarly, the coccyx is supported on a separate and distinct pouch from each of the ischial tuberosities. Additionally, the base member 6 is preferably a contoured foam cushion or relatively rigid tray; however, the base member on which the fluid pad is positioned could be any member with an upper surface such as the sling or solid seat of a wheelchair, a car seat, a simple flat surface, a ground surface, or even another fluid pad.

While several embodiments of the present invention have been shown and described in detail, it is to be understood that various changes and modifications could be made without departing from the scope of the invention.

We claim:

1. In a seating system having a base member with an upper surface and a pad positioned on said upper surface to receive and support a user's buttocks including the user's ischial tuberosities and coccyx, the improvement wherein said pad includes at least three separate and distinct pouches containing a fluid having a viscosity of at least one and means for positioning a first of said three pouches under one of the user's ischial tuberosities, a second of said three pouches under the other of the user's ischial tuberosities, and a third of said three pouches under the user's coccyx, each pouch including means for sealing the fluid within each pouch to prevent fluid communication with the fluid in the other two pouches wherein each pouch has at least portions thereof respectively positioned immediately adjacent a portion of each of the other two pouches.

2. The improvement of claim 1 wherein the sealing means of at least one pouch and the sealing means of another pouch include a common sealing seam.

3. The seating system of claim 1 wherein the respective sealing means of said first and third pouches include a common sealing seam.

4. The improvement of claim 1 wherein the sealing means of each adjacent pouch portion include a common sealing seam between the respective adjacent portions.

5. The improvement of claim 1 wherein the first and second pouches are substantially the same size.

6. The improvement of claim 1 wherein the seating system receives and supports the user's buttocks including each half side of the user's buttocks and said first pouch is dimensioned substantially the same size as one of the half sides of the user's buttocks.

7. The improvement of claim 6 wherein said second pouch is dimensioned substantially the same size as the other half side of the user's buttocks.

8. The improvement of claim 1 wherein the third pouch is smaller than each of the respective first and second pouches.

9. The improvement of claim 1 wherein the first and second pouches are filled with substantially the same volume of fluid.

10. The improvement of claim 1 wherein the volume of fluid in the third pouch is less than the volume in each of the respective first and second pouches.

11. The improvement of claim 1 wherein the shape of the third pouch is substantially triangular.

12. The improvement of claim 1 wherein said first and second pouches have portions straddling said third pouch on each side thereof.

13. The improvement of claim 1 wherein said fluid is a highly viscous liquid.

14. The seating system of claim 3 wherein the upper surface of said base member extends outwardly on each side of a central plane passing through said upper surface and said pad is positioned on said upper surface with said first and third pouches having the common sealing seam therebetween extending outwardly of the central plane.

15. The seating system of claim 14 wherein said common sealing seam extends outwardly of said central plane at substantially 60 degrees.

16. The seating system of claim 15 wherein the respective sealing means of said second and third pouches include a common sealing seam and said positioning means positions said three pouches on the upper surface of said base member with the common sealing seams of said first and third pouches and of said second and third pouches extending outwardly of said central plane on opposite sides thereof.

17. The seating system of claim 16 wherein said common sealing seam between said second and third pouches extends outwardly of said central plane at substantially 60 degrees.

18. The seating system of claim 16 wherein the respective sealing means of said first and second pouches includes a common sealing seam and said positioning means positions said three pouches on the upper surface of said base member with the common sealing seam of said first and second pouches lying substantially in said central plane.

19. The seating system of claim 3 wherein the respective sealing means of said second and third pouches include a common sealing seam.

20. A seating system for supporting a user's buttocks including the user's ischial tuberosities and coccyx, said seating system including means for respectively supporting each of the user's ischial tuberosities and coccyx on one of at least three separate and distinct pouches, each pouch containing a fluid having a viscosity of at least one and further having sealing means for containing the fluid within each pouch to isolate and prevent fluid communication with the fluid in the other two pouches, said seating system further including a base member with an upper surface and means for positioning said pouches on said upper surface of said base member, said upper surface of the base member having three areas dimensioned to substantially correspond to the areas of the user's ischial tuberosities and coccyx and said positioning means positions a first of said three pouches substantially over the area of the upper surface corresponding to one of the user's ischial tuberosities, a second of said three pouches substantially over the area of the upper surface corresponding to the other of the user's ischial tuberosities, and a third of said three pouches substantially over the area of the upper surface corresponding to the user's coccyx whereby each of the user's ischial tuberosities and coccyx is respectively supported on one of the three separate and distinct pouches wherein the respective sealing means of said first and third pouches include a common sealing seam, the respective sealing means of said second and third pouches include a common sealing seam, and the respective sealing means of said first and second pouches include a common sealing seam.

21. The seating system of claim 20 wherein each of said first and second pouches respectively extends substantially in the range of three to five inches outwardly of said central plane.

22. The seating system of claim 20 wherein each of said first and second pouches respectively extends substantially in the range of five to seven inches along an axis extending in said central plane.

23. The seating system of claim 20 wherein said positioning means positions said third pouch to substantially straddle said central plane with portions of said third pouch extending outwardly of said central plane on each side thereof.

24. The seating system of claim 23 wherein said third pouch extends substantially two inches outwardly of said central plane on each side thereof.

25. The seating system of claim 20 wherein said first and second pouches are substantially mirror images of each other.

26. The seating system of claim 20 wherein said first and second pouches have portions straddling said third pouch on each side thereof.

27. The seating system of claim 27 wherein the seating system supports the user's buttocks including each half side of the user's buttocks and said first pouch is dimensioned substantially the same size as one of the half sides of the user's buttocks.

28. The seating system of claim 27 wherein said second pouch is dimensioned substantially the same size as the other half side of the user's buttocks.

29. The seating system of claim 20 wherein the shape of the third pouch is substantially triangular.

30. The seating system of claim 20 wherein said fluid is a highly viscous liquid.

31. The seating system of claim 20 wherein said upper surface of said base member is contoured.

32. A seating system for supporting a user's buttocks including the user's ischial tuberosities and coccyx, said seating system including means for respectively supporting each of the user's ischial tuberosities and coccyx on one of at least three separate and distinct pouches, each pouch containing a fluid having a viscosity of at least one and further having sealing means for containing the fluid within each pouch to isolate and prevent fluid communication with the fluid in the other two pouches, said seating system further including a base member with an upper surface and means for positioning said pouches on said upper surface of said base member, said upper surface of the base member having three areas dimensioned to substantially correspond to the areas of the user's ischial tuberosities and coccyx and said positioning means positions a first of said three pouches substantially over the area of the upper surface corresponding to one of the user's ischial tuberosities, a second of said three pouches substantially over the area of the upper surface corresponding to the other of the user's ischial tuberosities, and a third of said three pouches substantially over the area of the upper surface corresponding to the user's coccyx whereby each of the user's ischial tuberosities and coccyx is respectively supported on one of the three separate and distinct pouches, said upper surface of said base member extending outwardly on each side of a central plane passing through said upper surface and said positioning means positions said first and second pouches on said upper surface to extent outwardly of said central plane on opposite sides thereof, said seating system further including at least two additional pouches containing fluid and means for positioning one of said additional pouches outwardly of said first pouch relative to said central plane and means for positioning the second of said additional pouches outwardly of said second pouch relative to said central plane.

33. The seating system of claim 32 wherein said one additional pouch extends along an axis extending in said central plane for a distance substantially greater than said first pouch extends along said axis.

34. The seating system of claim 33 wherein said second additional pouch extends along said axis extending in said central plane for a distance substantially greater than said second pouch extends along said axis.

35. The seating system of claim 32 wherein said first pouch and said one additional pouch share a common sealing seam.

36. The seating system of claim 35 wherein said second pouch and said second additional pouch share a common sealing seam.

37. The seating system of claim 32 wherein the upper surface of said base member has two additional areas substantially corresponding to the areas of the user's left femur including trochanter and the user's right femur including trochanter and said seating system further means for positioning one of said additional pouches substantially over the area of the upper surface corresponding to the user's left femur including trochanter and said second additional pouch substantially over the area of the upper surface corresponding to the user's right femur including trochanter.

38. The seating system of claim 32 wherein said fluid is a highly viscous liquid.

39. The seating system of claim 32 wherein said upper surface of said base member is contoured.

40. In a seating system having a base member with an upper surface and a pad positioned on said upper surface to receive and support a user's buttocks including the user's ischial tuberosities and coccyx, the improvement wherein said pad includes at least three separate and distinct pouches containing a fluid having a viscosity of at least one and means for positioning a first of said three pouches under one of the user's ischial tuberosities, a second of said three pouches under the other of the user's ischial tuberosities, and a third of said three pouches under the user's coccyx, each pouch including means for sealing the fluid within each pouch to prevent fluid communication with the fluid in the other two pouches wherein each sealing means includes a sealing seam and said sealing seam for each pouch has at least a common portion with the sealing seam of each of the other two pouches.

41. The improvement of claim 40 wherein said fluid is a highly viscous liquid.

* * * * *